US010393451B2

(12) United States Patent
Tylutki et al.

(10) Patent No.: US 10,393,451 B2
(45) Date of Patent: Aug. 27, 2019

(54) STAMPED THERMAL EXPANSION RELIEF FEATURE FOR HEAT EXCHANGERS

(71) Applicant: DENSO International America, Inc., Southfield, MI (US)

(72) Inventors: Daniel Tylutki, Livonia, MI (US); Yasuhiro Ando, Battle Creek, MI (US); Brad Eklov, Kalamazoo, MI (US); Keith Brandau, Scotts, MI (US); Steven Maloney, Canton, MI (US); Alexander Taylor, Farmington Hills, MI (US)

(73) Assignee: DENSO International America, Inc., Southfield, MI (US)

( * ) Notice: Subject to any disclaimer, the term of this patent is extended or adjusted under 35 U.S.C. 154(b) by 506 days.

(21) Appl. No.: 13/745,917

(22) Filed: Jan. 21, 2013

(65) Prior Publication Data

US 2014/0202670 A1 Jul. 24, 2014

(51) Int. Cl.
*F28D 1/00* (2006.01)
*F28F 7/00* (2006.01)
*F28F 9/00* (2006.01)

(52) U.S. Cl.
CPC ..... *F28F 9/001* (2013.01); *F28F 2265/26* (2013.01)

(58) Field of Classification Search
CPC ..... F28F 9/001; F28F 2265/26; F28D 1/04
USPC ..... 165/81, 149
See application file for complete search history.

(56) References Cited

U.S. PATENT DOCUMENTS

| | | | | |
|---|---|---|---|---|
| 4,719,967 | A | 1/1988 | Scarselletta | |
| 5,931,223 | A | 8/1999 | Yu et al. | |
| 6,129,142 | A | 10/2000 | Beldam | |
| 6,328,098 | B1 * | 12/2001 | Kodumudi | F28F 9/001 165/149 |
| 6,412,547 | B1 | 7/2002 | Siler | |
| 7,143,512 | B2 * | 12/2006 | Kroetsch et al. | 29/890.039 |
| 7,621,317 | B2 * | 11/2009 | Rousseau et al. | 165/81 |
| 7,921,902 | B2 * | 4/2011 | Horoho | F28F 9/001 165/149 |
| 2005/0150639 | A1 * | 7/2005 | Iwasaki et al. | 165/140 |
| 2007/0163751 | A1 * | 7/2007 | Balci et al. | 165/81 |
| 2007/0256819 | A1 | 11/2007 | Alcaine et al. | |
| 2008/0047689 | A1 * | 2/2008 | Hirose et al. | 165/81 |
| 2008/0135208 | A1 | 6/2008 | Horoho | |

* cited by examiner

*Primary Examiner* — Jason N Thompson
(74) *Attorney, Agent, or Firm* — Harness, Dickey & Pierce, P.L.C.

(57) ABSTRACT

A heat exchanger having at least one of side plates embodying a polygonal aperture through the planar base thereof, located at a predetermined position, and at least two corresponding shear-apertures located at the interface between the planar base and a first wall and a second wall of the side plate, each adjacent to the base aperture, providing at least one flexing location to accommodate thermal expansion of the heat exchanger during thermal cycling.

6 Claims, 6 Drawing Sheets

STAMPED THERMAL EXPANSION RELIEF FEATURE FOR HEAT EXCHANGERS

FIELD

The present disclosure relates to heat exchangers, and more particularly thermal expansion of heat exchangers.

BACKGROUND

This section provides background information related to the present disclosure which is not necessarily prior art. In the past, it has been known that a core structure of a heat exchanger 5 comprises of a plurality of tubes 7 through the inside of which an internal heat exchange medium passes, a plurality of fins alternately stacked with the tubes 7 and increasing the heat transfer of said heat exchange medium, end tanks 6 to which the two ends of the tubes are connected, and side plates 10 arranged at the outsides in the stacking direction from the end fins arranged at the outermost sides in the stacking direction of the fins and connected to the end tanks 6 (see FIG. 1).

In this types of core structure of a heat exchanger, the tubes and the corrugated fins are alternately arranged between the two end tanks arranged facing each other across a predetermined distance. The two ends of the two end tanks are bridged by the side plates 10. Further, the two ends of the tubes 7 and the side plates 10 are inserted into tube holes located in core plates (not shown) of the end tanks 6 and subsequently brazed.

However, in the aforementioned heat exchanger, when the heat exchange medium begins to pass through the tubes 7, the difference between the amount of heat expansion of the tubes 7 and the core plates which directly receive the effect of the heat exchange medium and the amount of heat expansion of the side plates 10 which do not directly receive the effect of the heat exchange medium causes thermal stress accompanied with thermal strain in the tubes 7 and the side plates 10. Further, if thermal stress is repeatedly generated, there is the problem of fatigue breakage in the vicinities of the tube and core plate interface.

As a countermeasure, there is the art described in U.S. Pat. No. 7,198,095. In this patent, there is a thermal expansion 'break-off zone' provided on the side plates. This design enables a predetermined breaking point, adapted to break when subjected to thermally-induced stress caused in the tubes during operation of the heat exchanger.

However, in this design, the complete breakage of the side plate provides a location for buckling of the corrugated fins and tubes adjacent to the side plates, creating a dimensional error of the core unit assembly.

U.S. Pat. No. 7,389,810 improves on this, by providing a flexible zone to accommodate thermal expansion, but further requires a cutting process of the base portion during manufacturing, which must be accomplished prior to assembly of the heat exchanger. This cutting step makes post assembly alignment and brazing difficult.

SUMMARY

In light of the above deficiencies in the prior art, an object of the present invention is to provide a heat exchanger able to prevent breakage at the joints of the tubes and the side plates at the core plates, able to be easily produced, and reduced in cost which has side plates enabling stable brazing of the tubes and the fins with the side plates.

According to a first aspect of the present invention, there is provided a heat exchanger wherein at least one of the side plates 10 has a polygonal aperture through the planar base of the side plate at a predetermined position, and at least two corresponding shear-apertures located at the interface between the planar base and a first wall and a second wall of the side plate, each adjacent to the base aperture.

Due to this, when brazing the tubes and the fins with the side plates, the rigidity of the side plates is still maintained (flexing is difficult) and the tubes and the fins can be uniformly pressed with the side plates. Because of this, stable brazing of the tubes and the fins with the side plates becomes possible, yet, while still providing a flex-area to allow thermal expansion and contraction of the heat exchanger assembly without breakage of the side plate during thermal cycling.

According to a second embodiment of the present disclosure, after brazing, at least one location of the side walls proximal the shear aperture is cut. Due to this, even if the side plates thermally expand during use of the heat exchanger, since the rigidity is low, simple expansion and contraction become further enhanced in the longitudinal direction and thermal stress can be reduced.

Note that the reference numerals of the above parts show the correspondence with specific parts described in the embodiments explained later.

DRAWINGS

The drawings described herein are for illustrative purposes only of selected embodiments and not all possible implementations, and are not intended to limit the scope of the present disclosure.

Figure 2:
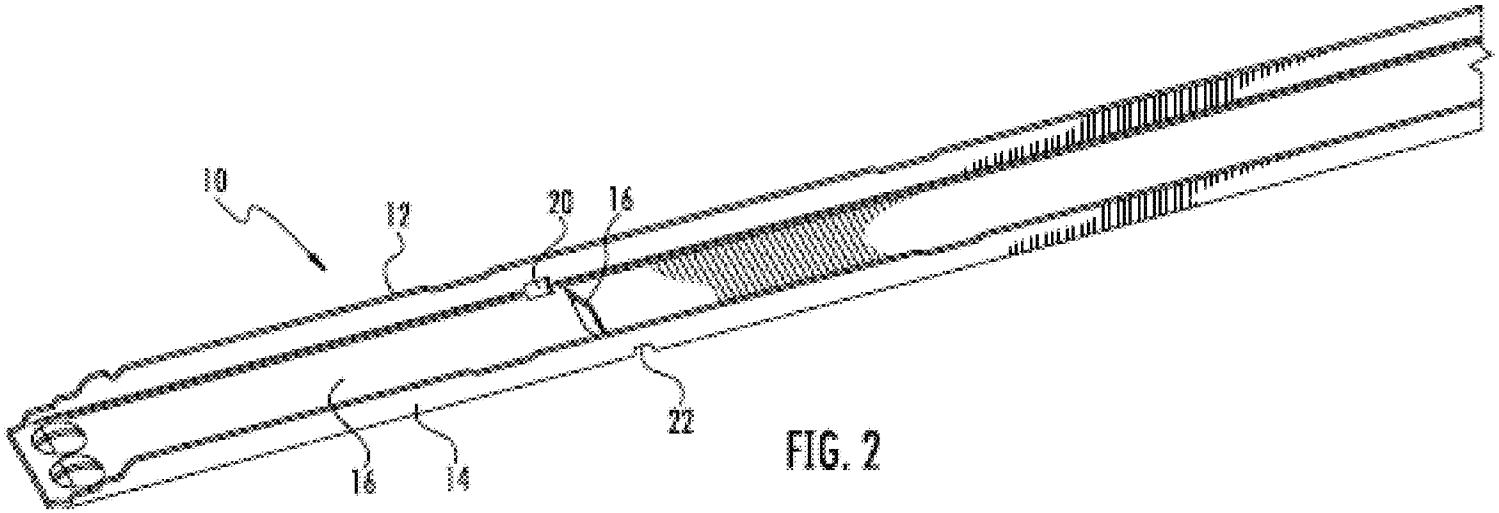
FIG. 2 is a partial perspective view of a first embodiment depicting a side plate for a heat exchanger of the present disclosure.
Figure 4A:
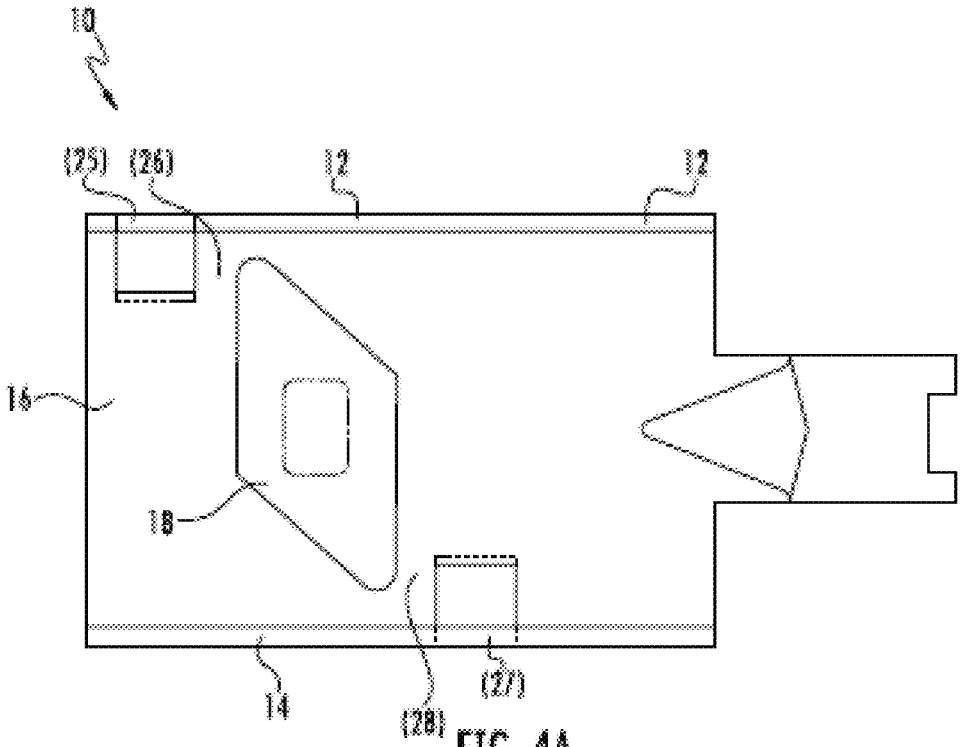
Figure 4B:
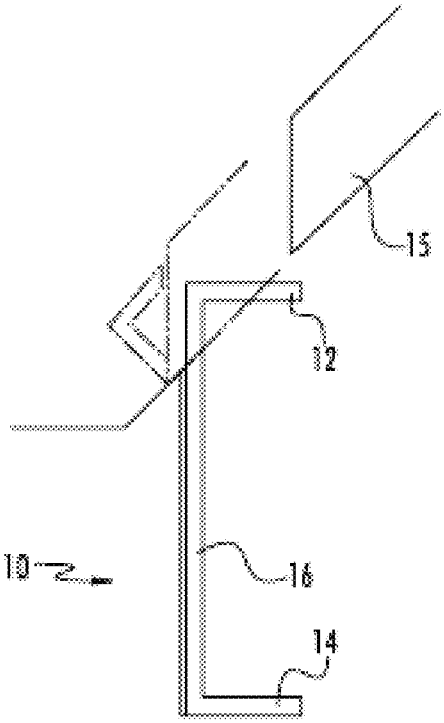
Figure 5:
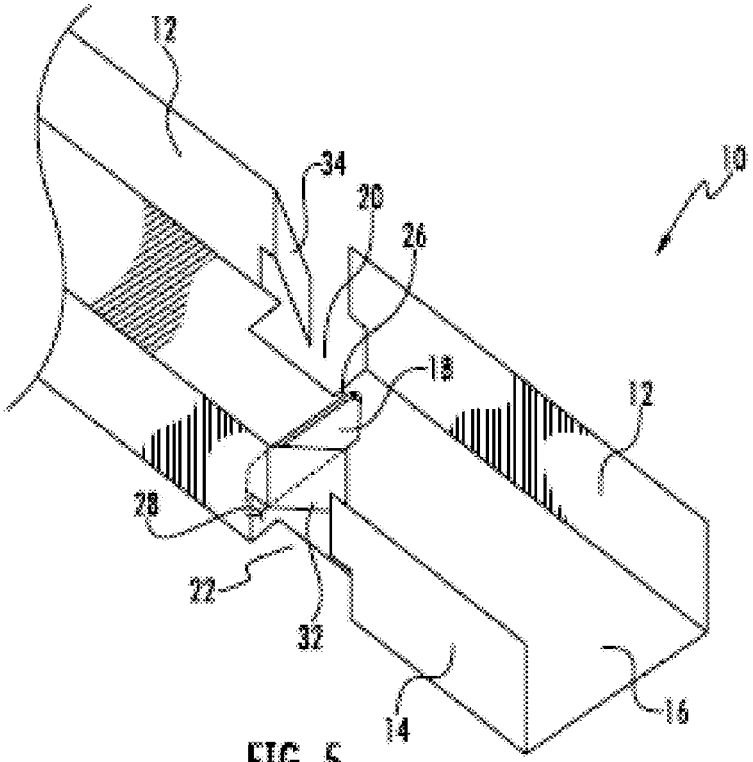
Figure 5A:
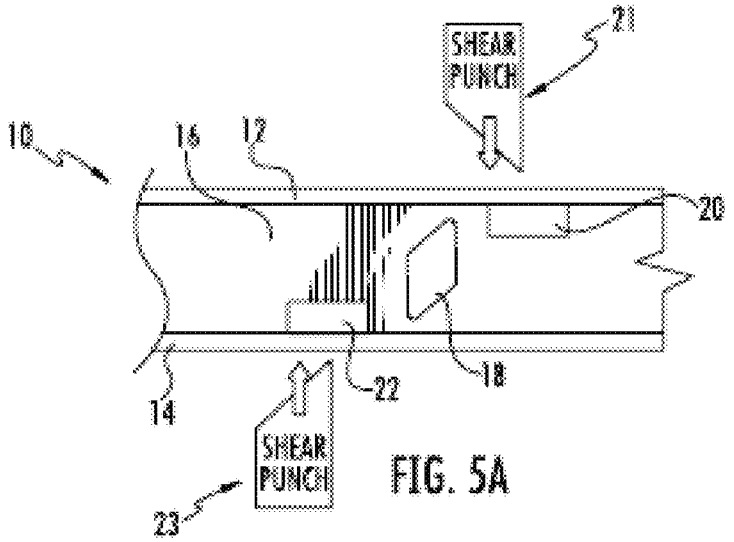
Figure 5B:
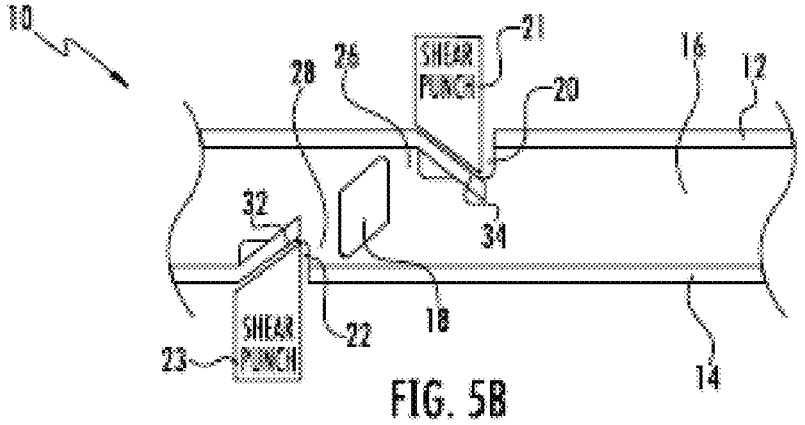

FIG. 4*a* is partial top planar view of a detailed portion of the side plate of FIG. 2;

FIG. 4*b* is end view of a detailed portion of the side plate of FIG. 4A;

FIG. 5 is a partial perspective view of a second embodiment depicting a side plate for a heat exchanger of the present disclosure;

FIG. 5*a* is top planar view of the second embodiment prior to the secondary punching operation; and FIG. 5*b* is top planar view of the second embodiment during the secondary punching operation.

Corresponding reference numerals indicate corresponding parts throughout the several views of the drawings.

DETAILED DESCRIPTION

Example embodiments will now be described more fully with reference to the accompanying drawings. The following description is merely exemplary in nature and is not intended to limit the present disclosure, application, or uses. It should be understood that throughout the drawings, corresponding reference numerals indicate like or corresponding parts and features.

Figure 1:
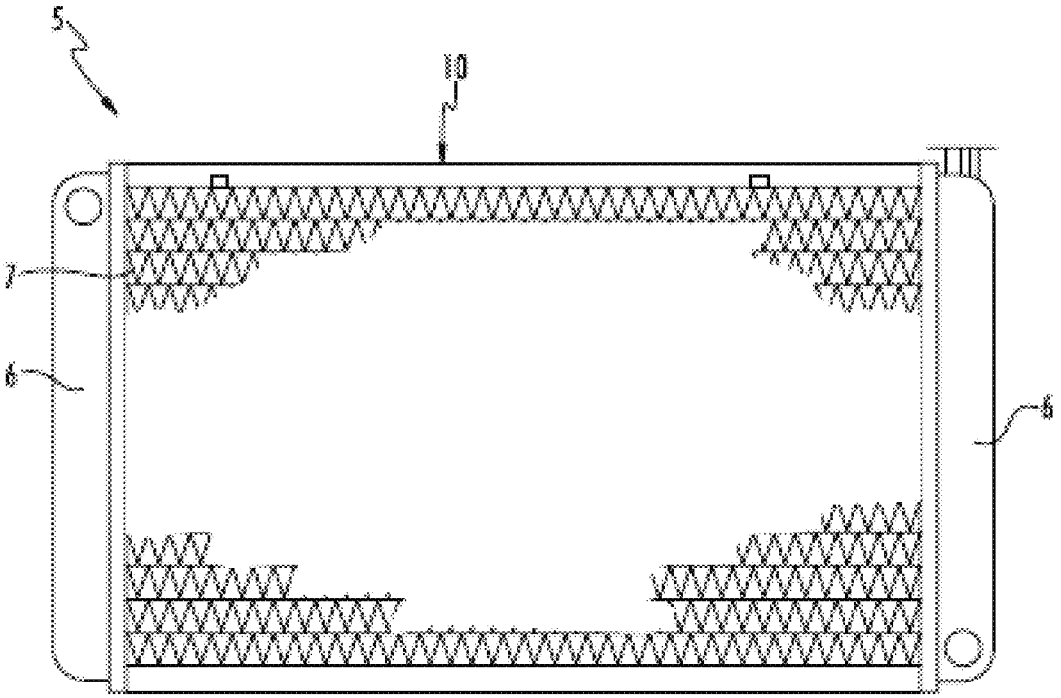
FIG. 1 is a side view of a heat exchanger of the present disclosure.

Referring now to FIG. 1, a standard heat exchanger 5 for use in automobile applications is shown. The heat exchanger 5 is of the tube and fin type, comprising a plurality of tubes 7 interconnected to an end tank 6 at each end through a core plate (not shown). Staggered between each tube is a corrugated fin for increasing heat exchange performance between the fluid traversing the tubes and the air passing through the fins, perpendicular to the longitudinal direction of the tubes.

The heat exchanger 5 further embodies at least one side plate 10, in contact with the last row of corrugated fins, which interconnects the end tanks 6 through the core plate, and maintains the structural integrity of the tube and fin assembly during assembly and installation.

Figure 3:
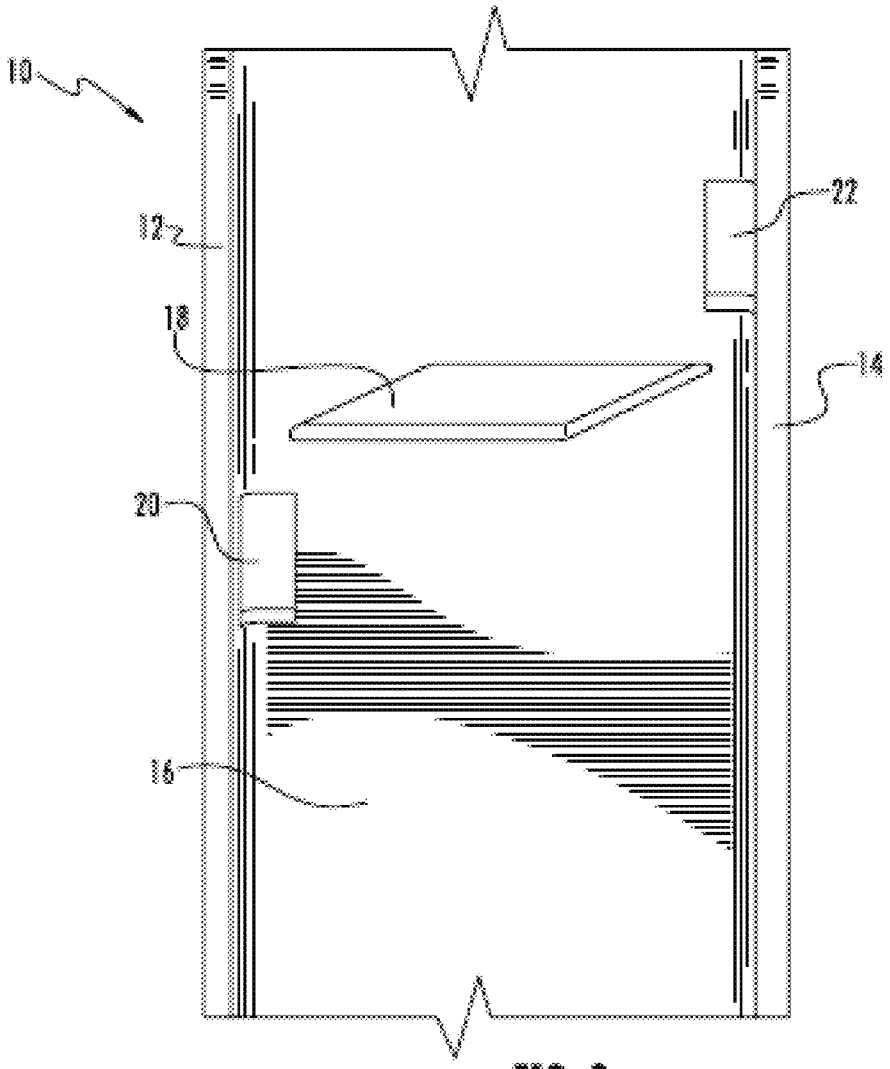
FIG. 3 is a partial bottom planar view of a detailed portion of the side plate of FIG. 2.

Referring now to FIGS. 2 and 3, a first embodiment of the present disclosure will be explained in detail. As illustrated, the side plate 10 of the heat exchanger assembly comprises a generally planar base portion 16, and generally perpendicular side walls 12 and 14 extending in a stacking direction of the tubes and fins. The planar base portion comprises at least one polygonal base aperture 18, positioned perpendicular to a longitudinal direction of the side plate spanning approximately the width of the base portion 16. This aperture as depicted is a diamond shape (rhombus shape), but it should be understood that any similar polygonal shape having similar dimensions would yield similar results, and therefore intended to be within the scope of this application.

This base aperture 18 can be formed by cutting or drilling, but preferably is formed by a punch. Staggered latitudinal, and straddling longitudinally on either side of the base aperture 18 of the base portion 16, are two interface apertures 20, 22 located at the interface between the base portion 16 and the walls 12 and 14 respectively. These interface apertures 20, 22 each define an opening extending partially up the side walls 12 and 14, and further extending laterally across the base portion a pre determined distance, so as to overlap the base aperture 18 in a longitudinal direction of the side plate 10 a predetermined distance.

As illustrated in FIGS. 4*a* and 4*b*, these interface apertures 20, 22 are formed subsequent to aperture 18, by a shear punch 15 operating at a 45 degree angle in reference to the planar base portion of the side plate 10.

This configuration of interface apertures 20, 22 located on either side of base aperture 18 creates flex bridges 26 and 28 in the planar base portion 16, as well as perpendicular flex portions 25 and 27 in the walls 12 and 14 respectively above adjacent shear apertures 20, 22.

In operation, these flex bridges 26, 28 and flex portions 25, 27 provide for areas in the side plate 10 to contract and expand during thermal cycling, in both the latitudinal and longitudinal dimensions of the heat exchanger with reference to the direction of the plurality of pipes, while still maintaining the overall structural integrity of the assembly.

Referring now to FIG. 5, a secondary embodiment of the present invention is shown. In order to increase the thermal flexing of the heat exchanger side plate 10 during thermal cycling, an additional cutting operation is performed as illustrated in FIGS. 5*a* and 5*b*. Preferably this operation is conducted after the side plate is brazed onto the heat exchanger, but it could optionally be conducted prior to assembly.

As shown in FIGS. 5*a* and 5*b*, the side plate 10 is aligned in a shear punch machine which comprises staggered shear punches 21 and 23, positioned on opposite sides of the side plate 10, so as to align with interface apertures 20, 22 respectively. The shear punches then operate to sever and partially deflect the wall portions 32, 34 located above the interface apertures 20, 22 inward, yielding only flex bridges 26, 28 as the remaining connection means for maintaining the side plate 10 as a single structure. This embodiment provides greater flexibility in the latitudinal direction during thermal cycling, while still maintaining the overall structural integrity of the assembly.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

What is claimed is:

1. A heat exchanger comprising:

a core unit including a plurality of tubes and a plurality of fins stacked alternately with each other;

tanks arranged at the ends in a longitudinal direction of the tubes of the core unit and communicating with the plurality of the tubes; and at least one side plate arranged at one end in a stacking direction of the tubes of the core unit and having the ends thereof coupled to the tanks;

wherein the side plate includes a base portion in contact with a top row of the plurality of stacked fins and two side walls extending perpendicular from the base portion in the stacking direction of the tubes;

wherein the base portion comprises at least one thermal expansion zone, comprising a single elongated polygonal aperture, perpendicular to the longitudinal direction of the tubes extending a predetermined distance towards an interface between the base portion and each of the side walls;

wherein a pair of interface apertures, each discontinuous and separate from the polygonal aperture, are staggered in a latitudinal direction of the tubes on either side of the polygonal aperture, one of which interface apertures extending a predetermined distance up one of each of the side walls, and across the base portion a predetermined distance so as to each overlap in a longitudinal planar direction with the polygonal aperture in the base portion relative to the tubes, and wherein a flexible bridge is defined in the latitudinal direction of, and perpendicular to the tubes located between each interface aperture, and the polygonal aperture.

2. The heat exchanger of claim 1, wherein the polygonal aperture is a rhombus.

3. The heat exchanger of claim 1 further defining a flexible portion located on the sidewalls aligned laterally with the interface aperture, located distally from the base portion.

4. The heat exchanger of claim 1 wherein the pair of interface apertures do not overlap each other in a longitudinal planar direction relative to the tubes.

5. A heat exchanger comprising:

a core unit including a plurality of tubes and a plurality of fins stacked alternately with each other;

tanks arranged at the ends in a longitudinal direction of the tubes of the core unit and communicating with the plurality of the tubes; and at least one side plate arranged at one end in a stacking direction of the tubes of the core unit and having the ends thereof coupled to the tanks;

wherein the side plate includes a base in contact with a top row of the plurality of stacked fins and two side walls extending perpendicular from the base portion in the stacking direction of the tubes;

wherein the base portion comprises at least one thermal expansion zone, comprising a single elongated polygonal aperture, perpendicular to the longitudinal direction of the tubes extending a predetermined distance in both directions towards an interface between the base portion and each of the side walls;

wherein a pair of interface apertures, each discontinuous and separate from the polygonal aperture, are staggered in a latitudinal direction of the tubes on either side of the polygonal aperture, each interface aperture extending a predetermined distance up the side wall, terminating prior to a distal, top-side edge of the side wall defining a flexible portion, and each interface aperture further extending across the base portion a predetermined distance so as to each overlap in a longitudinal planar direction with the polygonal aperture in the base portion, but not with each other, and wherein a flexible bridge is defined in the latitudinal direction of, and perpendicular to the tubes located between each interface aperture, and the polygonal aperture.

6. The heat exchanger of claim 5, wherein the polygonal aperture is a rhombus.

* * * * *